US011255064B2

(12) United States Patent
Halonen

(10) Patent No.: US 11,255,064 B2
(45) Date of Patent: Feb. 22, 2022

(54) DRIVING CYLINDER OF A PILE DRIVING RIG AND A PILE DRIVING RIG

(71) Applicant: Junttan Oy, Kuopio (FI)

(72) Inventor: Antti Halonen, Lapinlahti (FI)

(73) Assignee: Junttan Oy, Kuopio (FI)

( * ) Notice: Subject to any disclaimer, the term of this patent is extended or adjusted under 35 U.S.C. 154(b) by 317 days.

(21) Appl. No.: 16/341,928

(22) PCT Filed: Nov. 17, 2016

(86) PCT No.: PCT/FI2016/050810
§ 371 (c)(1),
(2) Date: Apr. 15, 2019

(87) PCT Pub. No.: WO2018/091767
PCT Pub. Date: May 24, 2018

(65) Prior Publication Data

US 2019/0249389 A1 Aug. 15, 2019

(51) Int. Cl.
*E02D 7/10* (2006.01)
*E02D 7/00* (2006.01)

(52) U.S. Cl.
CPC ..... *E02D 7/10* (2013.01); *E02D 7/00* (2013.01)

(58) Field of Classification Search
CPC ..... B25D 9/18; E02D 7/10; E02D 7/00
See application file for complete search history.

(56) References Cited

U.S. PATENT DOCUMENTS

| | | | | |
|---|---|---|---|---|
| 4,945,998 | A * | 8/1990 | Yamanaka | B25D 9/145 173/207 |
| 5,806,610 | A | 9/1998 | Sapozhnikov | |
| 2009/0200241 | A1 | 8/2009 | Harman et al. | |
| 2014/0314495 | A1 * | 10/2014 | Arentsen | E02D 7/10 405/232 |
| 2016/0318166 | A1 * | 11/2016 | Morita | E21B 1/00 |
| 2019/0226173 | A1 * | 7/2019 | Desborough | E02D 7/10 |

FOREIGN PATENT DOCUMENTS

| | | | |
|---|---|---|---|
| CN | 1986109 | A | 6/2007 |
| CN | 202718124 | U | 2/2013 |
| CN | 103233939 | A | 8/2013 |
| CN | 103422503 | A | 12/2013 |
| CN | 104912854 | A | 9/2015 |
| CN | 105829631 | A | 8/2016 |

(Continued)

OTHER PUBLICATIONS

Written opinion of PCT/FI2016050810 issued by searching authority European Patent Office dated Feb. 22, 2017, 6 pages.

(Continued)

*Primary Examiner* — Carib A Oquendo
(74) *Attorney, Agent, or Firm* — MacMillan, Sobanski & Todd, LLC

(57) ABSTRACT

A driving cylinder of a pile driving rig includes a solenoid valve for controlling an operation of the driving cylinder, which solenoid valve, is a slide valve, which is located at least partly at a piston-side head of the driving cylinder, and a stem of the slide valve is at least partly outside an inner cylinder liner in a direction of motion of a piston part. Further disclosed is a pile driving rig comprising the driving cylinder according to the invention.

21 Claims, 7 Drawing Sheets

(56) References Cited

FOREIGN PATENT DOCUMENTS

| | | | |
|---|---|---|---|
| JP | 07903 | B2 | 1/1995 |
| KR | 1998059373 | | 10/1998 |
| RU | 2095566 | C1 | 11/1997 |
| RU | 2203359 | C2 | 4/2003 |
| RU | 2265721 | C1 | 12/2005 |
| SU | 1073378 | A1 | 2/1984 |
| WO | 2012052601 | A1 | 4/2012 |

OTHER PUBLICATIONS

Notice of allowance of RU2019118484 issued by Russian Patent Office dated Jan. 9, 2020 (17 pages).

* cited by examiner

DRIVING CYLINDER OF A PILE DRIVING RIG AND A PILE DRIVING RIG

PRIORITY

This application is a U.S national application of the international application number PCT/FI2016/050810 filed on Nov. 17, 2016.

FIELD OF THE INVENTION

The object of the invention is a driving cylinder of a pile driving rig and a pile driving rig.

BACKGROUND OF THE INVENTION

A driving cylinder is a hydraulic actuator located inside the hammer of a hydraulic pile driving rig, the purpose of the driving cylinder being reciprocate the ram block impacting the driven pile during the driving of the pile into the ground. In currently known hydraulic pile driving rigs, the driving cylinder is usually a double-acting differential hydraulic cylinder, in which the piston rod side cylinder chamber is connected to the piston-side cylinder chamber, most typically by means of a hydraulic hose, or in such a way that the cylinder part is comprised of two cylinder liners within each other, in which case the pressure medium may be conveyed from one cylinder chamber to another through the empty space left between the cylinder liners fitted within each other. By means of this arrangement, the movement of the moving end of the driving cylinder is rendered as rapid as possible because the pressure medium flowing out of the cylinder chamber on the side of the direction of motion of the piston (that is, the cylinder chamber decreasing in volume) can be conveyed to the side of the working cylinder chamber (that is, the cylinder chamber increasing in volume). This type of an arrangement also simplifies the structure and operation of the pressure medium control valve system, because when using a driving cylinder functioning in this manner for controlling the pressure medium for reciprocating the moving end of the driving cylinder, it suffices that the pressure medium outlet duct connected to the piston side chamber and the pressure medium duct between the cylinder chambers are closed and opened in turn.

During the use of the pile driving rig, high impact-like loads are exerted on the driving cylinder, which also generate transverse forces on the driving cylinder. Because of this, the aim has been to fasten the driving cylinder to the structures of the hammer with a suitably flexible fastening. In known solutions, the driving cylinder is fastened, for example, from its piston-side end (upper end) with an articulation and from its piston rod side end (lower end) with a flexible fastening. Another alternative has been to fasten the driving cylinder to the hammer with an articulation from a fastening point at its centre, the aim being to locate the fastening point as close to the centre of gravity of the driving cylinder as possible. Usually, the moving end of the driving cylinder is fastened to the ram block in an articulated manner with a shackle.

In currently known driving cylinders, the solenoid valve of the driving cylinder is usually located outside the cylinder liners of the heads of the driving cylinder. The disadvantage of these currently known driving cylinder solutions is that the implementation of the solenoid valve closing and opening the pressure medium ducts between the cylinder chambers and leading away from the chambers is complex, requires a considerable number of gaskets due to the several joints and is, therefore, laborious to service and repair.

Patent publication US 5,806,610 discloses a known apparatus for generating impacts for a pile driving rig. The apparatus has a hydraulic cylinder with reciprocating piston located within the hydraulic cylinder.

BRIEF SUMMARY OF THE INVENTION

The aim of the invention is to introduce a new type of driving cylinder for a pile driving rig, which is structurally simpler than before, more durable, and has a solenoid valve which requires less maintenance and repair than before. A further aim of the invention is to introduce a pile driving rig equipped with a driving cylinder according to the invention.

The aim of the invention is achieved with a driving cylinder, wherein the solenoid valve guiding pressure medium into the cylinder part is a slide valve, which is located at least partly inside at the piston-side head of the driving cylinder, and the slide valve stem of which is at least partly outside the inner cylinder liner in the direction of movement of the piston part, in which case the solenoid valve may be implemented in a simpler way and, for example, with a smaller amount of gaskets between the different parts of the solenoid valve and of the driving cylinder and external flow ducts of the slide valve. More specifically, the driving cylinder of a pile driving rig according to the invention is characterized by what is described in independent claim 1, and the pile driving rig is characterized by what is described in dependent claim 12. Dependent claims 2 to 11 describe preferred embodiments of the driving cylinder of a pile driving rig according to the invention, and dependent claims 13 to 21 describe preferred embodiments of the pile driving rig according to the invention.

The advantage of the driving cylinder of the pile driving rig according to the invention is that the solenoid valve can be made simpler, more durable and more reliable than before. Due to this, the number of separate parts requiring tightness and precise dimensioning, such as hoses and valves outside the driving cylinder, decreases and thus the driving cylinder and a pile driving rig equipped with such driving cylinder, are simplified and more economical in terms of manufacturing costs. This type of driving cylinder also has the following advantages:

- The slide valve may be implemented in such a way that the pressure of the pressure medium, which affects the slide valve stem, is always equal on both sides of the stem, whereupon the slide valve stem of a pressurized driving cylinder is always in force balance. On account of this, the volume flow requirement of control is lower, which means that the control ducts of the slide valve may be smaller, thus rendering the overall external dimensions of the driving cylinder smaller and the driving cylinder itself lighter.
- Structures subject to the pressure of the pressure medium have no welded joints, which results in better fatigue durability and easier manufacture.
- Conveying the pressure medium from the well utilised pressure accumulators mounted in conjunction with the driving cylinder may be done along the shortest route to the piston rod side head. This gives good operating efficiency with low vibrations in the pressure line.
- The pressure medium may be conveyed away from the driving cylinder along a short route by utilising the damping of the pressure accumulators. This improves operating efficiency, decreasing the strength of oscillations in the return line.

In the driving cylinder is achieved an even load distribution throughout, because the flow of pressure medium can be made to affect both the solenoid valve of the driving cylinder and also its cylinder and piston parts symmetrically.

The slide valve stem of a pressurised driving cylinder is in balance with respect to the forces acting on it. The stem is hollow and the same pressure acts on both of its ends. On different sides of the control lug prevails either the control pressure of the stem or it is connected to the outlet line.

The piston-side head is a replaceable module, which means that it is possible to add new functions (e.g. slow drive) to the driving cylinder subsequently by modifying the piston-side end and the slide valve located in conjunction with it.

The diameter of the slide valve stem can thus be made smaller than the stem located outside the inner cylinder liner, whereupon it becomes lighter and thus the slide valve becomes faster.

All bores in the slide valve casing can be made symmetrical around the stem. As a result of this, the flow of pressure medium is steady in all directions, which means that no transverse forces with respect to its direction of movement are exerted on the stem, which forces could cause the stem to seize on the slide valve body.

The same driving cylinder can be made either such that it either does not have an upper rod or has an upper rod, that is, the piston rod may extend outside the cylinder part either only from one end of the driving cylinder (the piston rod side end) or both ends, in which case there is a gasket housing at the piston-side end and in that case the piston rod also passes through the end where the slide valve acting as the solenoid valve of the driving cylinder is.

The modular structure makes it possible to have a wide production range by means of which can be implemented various lifting and acceleration forces and thus be responded well to different production requirements. Furthermore, late variation of production is possible due to the modular structure.

A cylinder structure without an upper rod is functionally advantageous, because it can be utilised to shorten the overall length of the hammer approximately by one stroke length (1 m). On account of this, smaller cranes can be used for moving pile driving rigs at construction sites.

In a preferred embodiment of the driving cylinder of a pile driving rig according to the invention, the fastening of the driving cylinder on the hammer body of the pile driving rig is implemented by means of a stroke damping mounting in a centre piece at the centre of gravity of the driving cylinder. This reduces the stroke-like loads exerted on the body of the hammer by the driving cylinder and noise.

In a preferred embodiment of the driving cylinder according to the invention, the fastening of the moving end of the driving cylinder to the ram block is implemented by means of a fixture fastened on the piston rod by means of a wedge attachment and on the ram block by means of a flexible flange attachment. Due to such fastening, the ram block, and on the other hand the driving cylinder, are not subjected to as strong transverse forces as in known solutions, where the end of the piston rod is attached to the ram block with an articulation.

DESCRIPTION OF THE DRAWINGS

The invention is described in greater detail in the following, with reference to the accompanying drawings, in which.

A DETAILED DESCRIPTION OF PREFERRED EMBODIMENTS OF THE INVENTION

Figure 1:
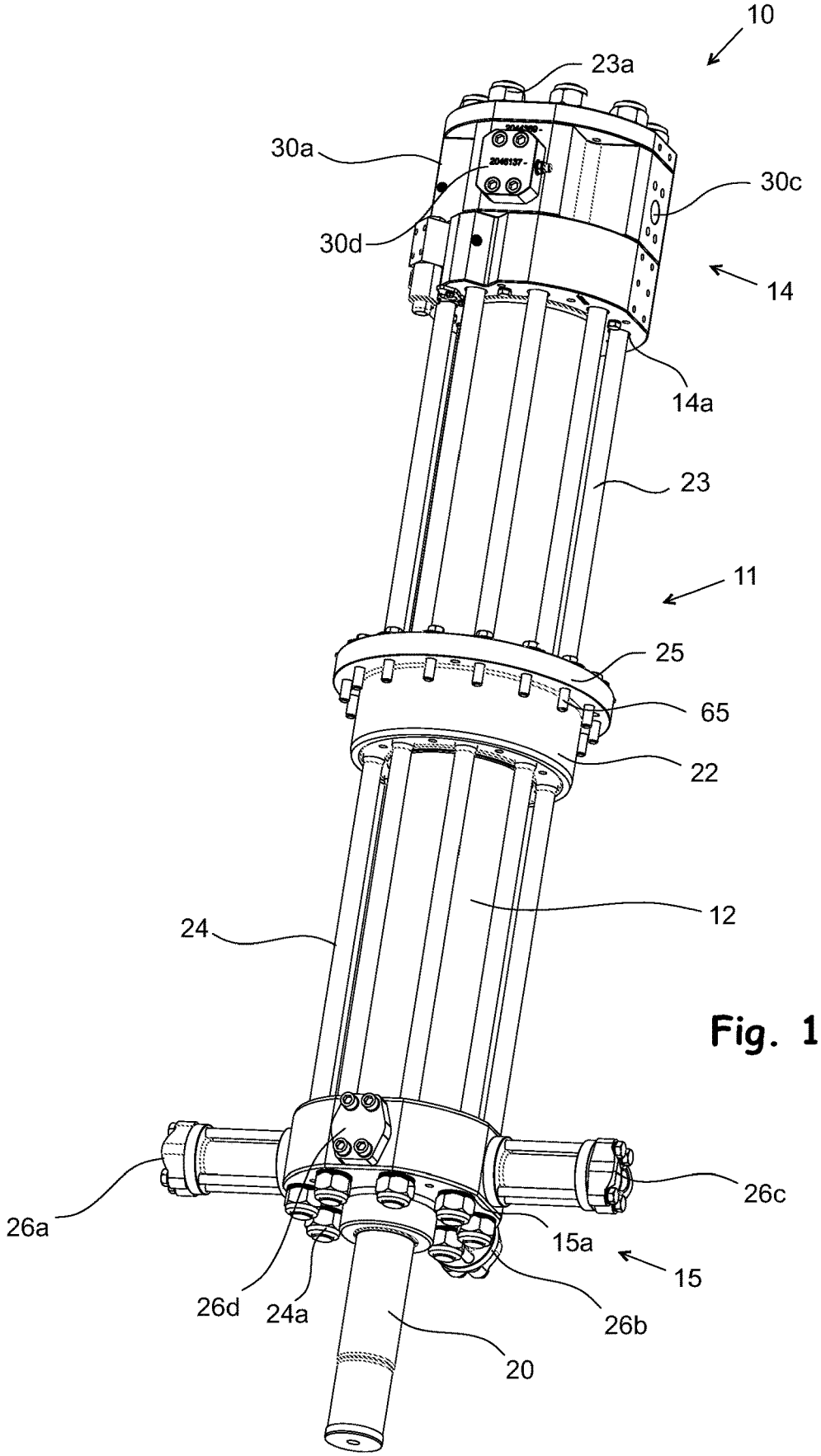
FIG. 1 shows a driving cylinder according to the invention, as seen diagonally from the side.
Figure 2:
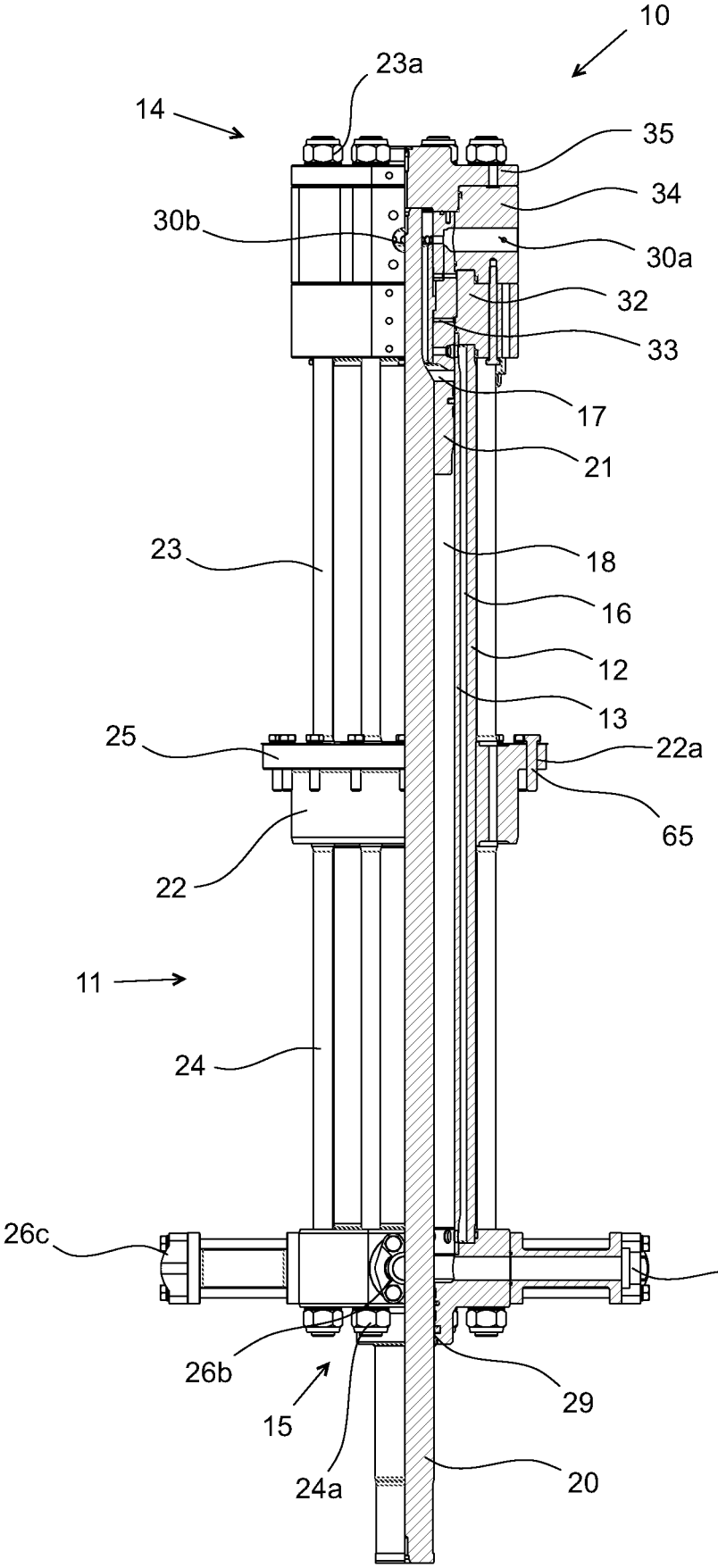
FIG. 2 shows the driving cylinder of FIG. 1 as a partial cross-sectional side view.
Figure 8:
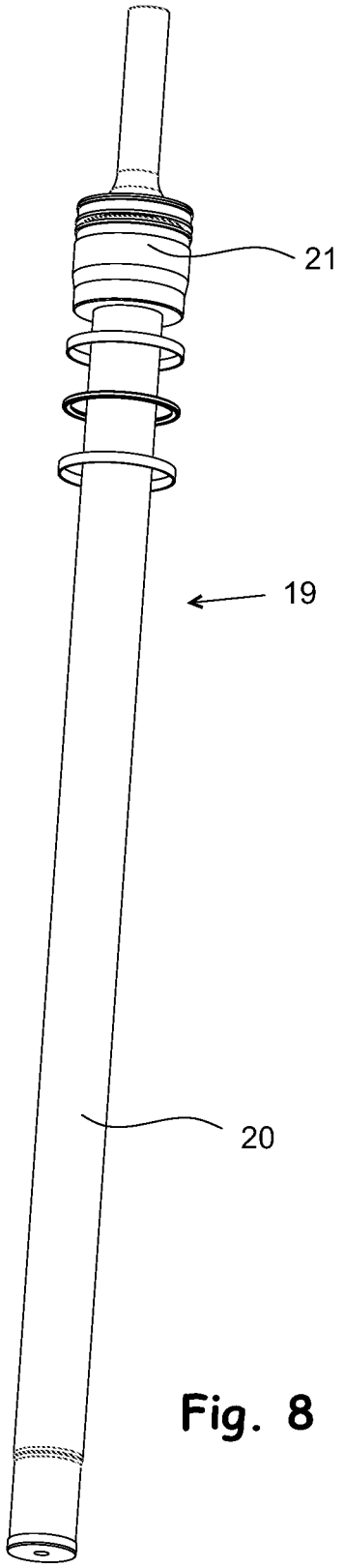
FIG. 8 shows the piston rod and the piston in it comprised in the driving cylinder of FIGS. 1 and 2 as a diagonal side view.
Figure 9:
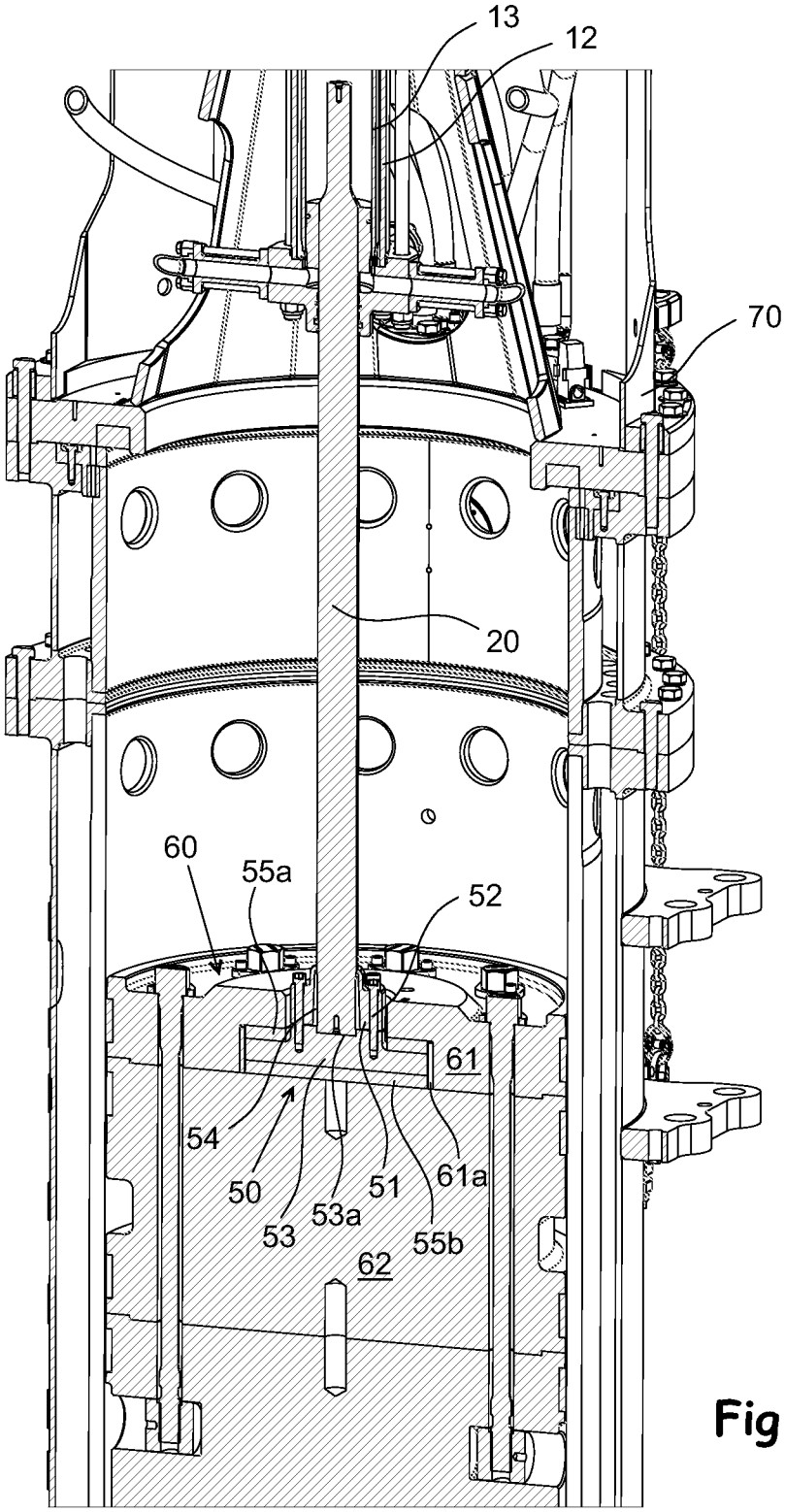
FIG. 9 shows a vertical cross-section of the hammer as a diagonal side view at the fixture of the piston rod and the upper part of the ram block.
Figure 10:
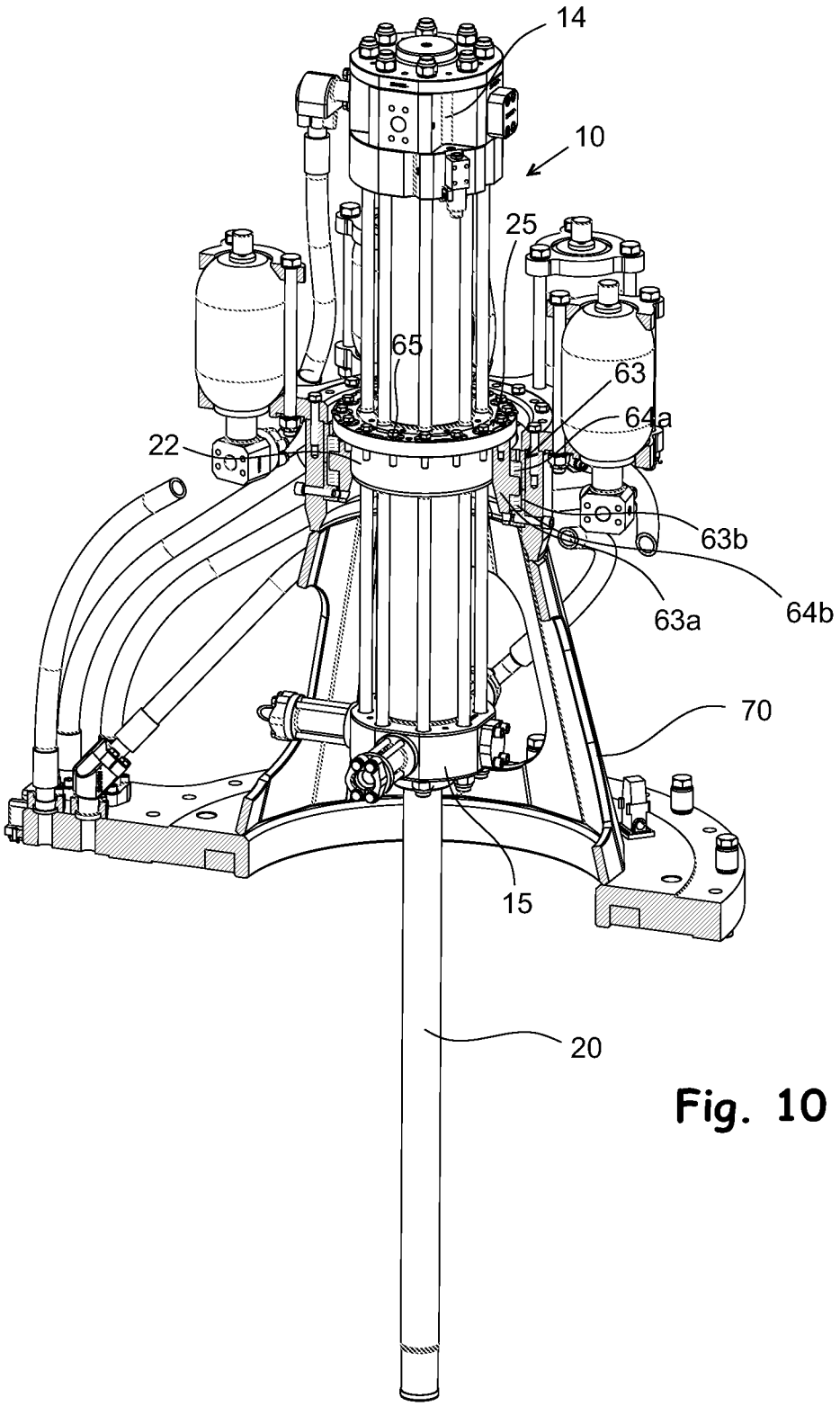
FIG. 10 shows a longitudinal cross-section of the inner parts of the hammer at the fastening point of the driving cylinder and around it.

The hydraulic driving cylinder 10 shown in FIGS. 1-10 is located in the upper part of the hammer in a pile driving rig, inside it, in the manner shown in FIG. 10, in such a way that it can be used to reciprocate the ram block 60 (shown in FIG. 9) located in the lower part of the hammer during the driving of the pile into the ground. The moving end of the driving cylinder 10, that is, the piston rod 20, is fastened by means of a fixture 50 (shown in FIG. 9) at its end to a fastening point in the upper part of the ram block. The driving cylinder is a double-acting differential cylinder, that is, the movement of the end moving in it is based on the fact that the force generated by the pressure medium at the moving end is greater above (i.e. in the piston-side chamber 17) the driving cylinder 10 moving inside the driving cylinder when the piston moves downwards, and greater below the piston (in the piston rod side cylinder chamber) when the piston moves upwards. This type of hydraulic cylinder can be controlled by means of one solenoid valve, which alternately closes and opens the connection between the cylinder chambers of the hydraulic cylinder, and where, when the cylinder chambers are closed, a connection from the piston-side cylinder chamber 17 to the pressure medium outlet duct is open, whereupon the pressure medium conveyed to the driving cylinder 10 discharges from the piston-side cylinder chamber 17 outside the driving cylinder, while the piston 21 moves in the direction of the piston-side head 14. The pressure medium used in the driving cylinder 10 of FIGS. 1 and 2 is most preferably hydraulic oil, but could also be another, typically liquid, pressure medium suitable for operating a driving cylinder.

Figure 6:
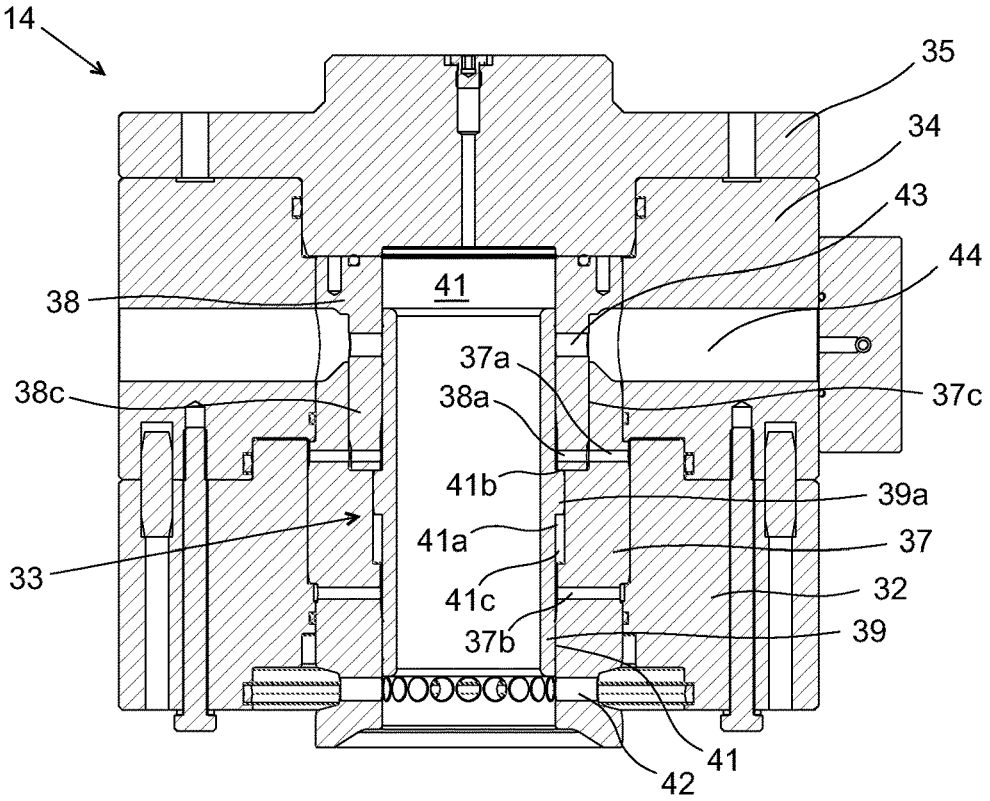
FIG. 6 shows a cross-section of the upper head of FIG. 4, as a section at the discharge ducts at the upper head (cross-section B-B shown in FIG. 4)
Figure 7:
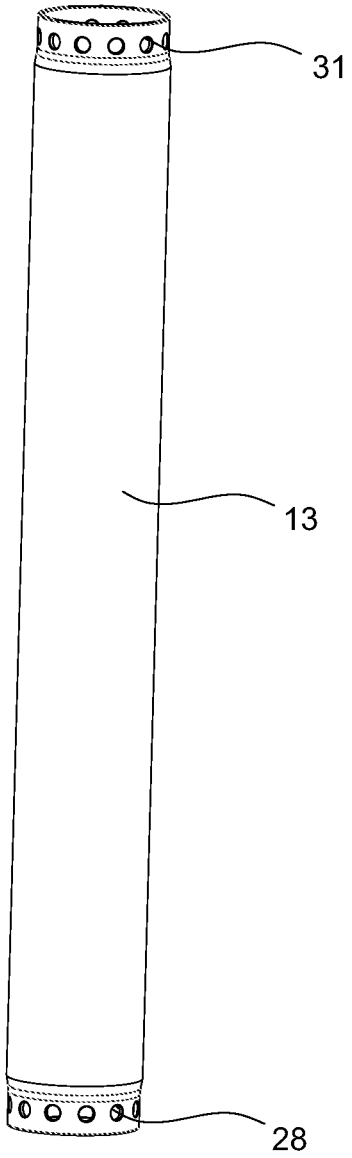
FIG. 7 shows the inner cylinder liner of the driving cylinder of FIGS. 1 and 2 as a diagonal side view.

The driving cylinder 10 shown in FIGS. 1-10 comprises a cylinder part 11 with an outer cylinder liner 12 and an inner cylinder liner 13 fitted within each other. The cylinder part 11 further comprises a piston-side end 14 and a piston rod side end 15 which close the outer cylinder liner 12 and inner cylinder liner 13 of the cylinder part 11 at their ends. Due to the outer cylinder liner 12 and inner cylinder liner 13 being positioned within each other, between them and the inner cylinder liner 13 is formed a closed pressure-tight space. The purpose of the space 16 between the outer cylinder liner 13 and inner cylinder liner 13 is to act as a connecting channel between the piston-side cylinder chamber 17 formed inside the inner cylinder liner 13 and the piston rod side cylinder chamber 18. The actual hydraulic cylinder carrying out the mechanical work thus consists of an inner cylinder liner 13 and a piston part 19 reciprocating inside it. The inner cylinder liner 13 is shown in FIG. 7.

The piston part 19 comprises a piston rod 20 extending from inside the inner cylinder liner 13 outside it, a piston 21 fitted tightly movably inside the inner cylinder liner 13, and a fixture 50 in the part extending outside the inner cylinder liner 13 of the piston rod 20, in order to fasten the piston rod 20 to the ram block 60 moved inside the hammer of the pile driving rig. FIG. 8 shows the piston part 19 of the driving cylinder 10 of FIGS. 1 and 2 when removed from inside the cylinder liner (without the fixture 50 at the end of the piston rod 20 and to be fastened to the ram block). FIG. 8 also shows the gasket and guide rings of the piston 21 when removed from the grooves in the piston 21.

The fastening of the piston rod 20 to the end of the ram block 60 by means of the fixture 50 is shown in FIG. 9. At the end of the piston rod 20 is a fastening sleeve 51, which is fastened with fastening screws 52 to a lifting disc 53 underneath the cylinder. The inner surface of the fastening sleeve 51 is slightly conical in such a way that its inner diameter is slightly smaller at its driving cylinder 10 side end (that is, upper end) than at the ram block side end (that is, lower end). Between the fastening sleeve 51 and the piston rod 20 is fitted a conical sleeve 54 which is in turn larger at its lower end than upper end. The lifting disc 53 has a piston rod head sized and shaped middle recess 53*a* in which the piston rod 20 end settles when the lifting disc 53 is fastened with fastening screws against the lower surface of the fastening sleeve with fastening screws, as shown in FIG. 9. The purpose of the middle recess 53*a* is to centre the lifting disc 53 with respect to the piston rod 20. The conical sleeve 54 presses against the fastening sleeve 51 and the lower end of the piston rod 20 when the lifting disc 53 is fastened in place. The lifting disc 53 simultaneously presses the piston rod 20 upwards at its end, whereupon the pressing joint formed by means of the conical sleeve 54 between the piston rod 20 and the fastening sleeve 51 tightens further. The fastening of the fixture 50 based on the conical sleeve 54 is durable and because of it, there is no need to make any grooves or the like to the end of the piston rod, such as threading and a spiral groove above the threading as in earlier fastening solutions, which has been found in earlier hammers to reduce the durability of the piston rod due to the dynamic tensile and compressive loads exerted on it during the use of the hammer.

The joint between the fixture 50 and the ram block 60 has been implemented as shown in FIG. 9, by fitting the lifting disc 53 in the fastening recess 61*a* on the lower surface of the head piece of the ram block 60 in such a way that there are damping material pieces of suitable rigidity between the fastening recess 61*a* and the lifting disc 53, and between the lower surface of the lifting disc and the body 62 of the ram block (upper damping material piece 55*a* and lower damping material piece 55*b*). In this case, the material of the damping material pieces 55*a* and 55*b* is polyurethane of suitable hardness. On the basis of test pile driving with a pile driving rig and research, this material has been found to dampen the impacts caused by the driving of the piles into the ground and vibration in the most appropriate way of all the materials tested. This type of fastening between the fixture 50 and the ram block 60 improves the durability of the different parts of the hammer (such as the driving cylinder) against the impact-like loads and vibration caused by the ram block. This type of fastening between the fixture 50 and the ram block 60 also reduces the noise caused by pile driving, because it prevents the transfer of vibrations caused by pile driving from the ram block to the piston rod 20 and from there further elsewhere in the driving cylinder 10.

The piston-side end 14 of the cylinder part 11 is fastened tightly to the piston-side end of the outer cylinder liner 12 and inner cylinder liner 13 in such a way that the pressure medium conveyed inside the driving cylinder will not be able to leak outside the driving cylinder 10 through the joint between the piston-side end 14 and the outer cylinder liner 12 and inner cylinder liner 13. The piston rod side end 15, on the other hand, is fastened tightly to the piston rod side end of the outer cylinder liner 12 and inner cylinder liner 13 in such a way that the pressure medium conveyed inside the driving cylinder will not be able to leak through the joint between the piston rod side end 15 and the outer cylinder liner 12 and inner cylinder liner 13. Thus, the piston 21 and the inner cylinder liner 13 and the piston-side end 14 limit the space called the piston-side cylinder chamber 17 in this application. Similarly, by a piston rod side cylinder chamber 18 is in this application referred to the space limited by the piston 21 and the inner cylinder liner 13 as well as the piston rod side head 18 inside the inner cylinder liner 13.

As shown in FIGS. 1 and 2, at the centre of the driving cylinder 10 is a centre piece 22 with mounting holes 22*a* from which the driving cylinder can be fastened to the body of the hammer of the pile driving rig. In this case, the centre piece 22 is located at the centre of gravity of the driving cylinder 10. The piston-side head 14 is fixed to the piston-side end of the outer cylinder liner 12 and inner cylinder liner 13 with piston-side studs 23 mounted between the centre piece 22 and the piston-side head, which studs are positioned at regular intervals in the circumferential direction of the driving cylinder 10 (in this case eight studs). The fastening of the piston rod side head 15 is implemented by means of piston rod side studs 24 mounted between the piston rod side end 15 and the centre piece 22, the number of studs equalling the number of piston-side studs 23. Both the piston-side studs 23 and the piston rod side studs 24 are threaded at both ends so that they can be screwed to the threaded mounting holes 22*b* in the centre piece 22. Furthermore, in this embodiment both the piston-side studs 23 and the piston rod side studs 24 are aligned, whereby the tightening force exerted by the head on the outer cylinder liner 12 and inner cylinder liner 13 is made to affect them as evenly as possible. All studs 23 and 24 are fixed to the heads by means of piston-side tightening nuts 23*a* and piston rod side tightening nuts 24*a* by fitting the studs 23 and 24 through the mounting holes 14*a* and 15*a* at the piston-side head 14 and piston rod side head 15, and by screwing the tightening nuts 23*a* and 24*a* suitably in such a way that the piston-side head 14 is pressed evenly against the piston-side end of the outer cylinder liner 12 and inner cylinder liner 13, and the piston rod side head 15 presses as evenly as possible against the piston rod side end of the outer cylinder liner 12 and inner cylinder liner 13. This type of method for fastening the piston-side head 14 and piston rod side head 15 is advantageous, because the long studs 23 and 24 act as flexible force elements by means of which the piston-side head 14 and the piston rod side head 15 can be made to remain against the outer cylinder liner 12 and the inner cylinder liner 13 by means of the evenly distributed tightening force better than before, irrespective of the high pressure acting inside the driving cylinder and its sudden variations. This fastening method also improves the durability of the structure because due to the length of the studs 23 and 24, the structure can yield more without the studs 23 and 24 deforming permanently.

The centre piece 22 is fixed to the outer cylinder liner 12 by means of a tight adapter. The outer cylinder liner 12 further comprises a lug (not shown in the Figures) on the piston-side head (that is, above) of the centre piece 22, against which lug the centre piece 22 settles with studs at the first stage of mounting of the piston-side head 14. In order to be able to position the centre piece 22 with the tight adapter in place against the lug in the outer cylinder liner during the mounting stage, the centre piece 22 is first heated and then the centre piece with an enlarged diameter is fitted through the piston rod side end of the outer cylinder liner against the said lug. On cooling, the centre piece shrinks and tightens on the outer liner against the lug.

The fastening of the centre piece 22 on the body 70 of the hammer is shown in FIG. 10. In this embodiment, the centre piece 22 comprises a fastening flange 25 by means of which the centre piece 22 is fastened to a bearing piece 63 to be fastened to the body 70 of the hammer. Between the bearing piece 63 and the body 70 of the hammer are damping material pieces 64*a* and 64*b* made of impact and vibration damping material, the pieces being in this case located between an inner part 63*a* fastened to the fastening flange 25 of the bearing piece 63 and an outer part 63*b* fastened with fastening screws 65 to the hammer body. The damping material pieces 64*a* and 64*b* are in this case annular pieces fitted in recesses formed in the inner part 63*a* of the bearing piece and the outer part 63*b* of the bearing piece, as shown in FIG. 10. The material of the damping pieces 64*a* and 64*b* is in this case polyurethane, that is, they may be, for example, pieces moulded and/or machined of polyurethane having suitable material properties. With such shock-absorbing fastening of the driving cylinder 10, impact-like loads and vibration transferred from the driving cylinder 10 to the hammer body 70 can be damped, and also the noise produced in pile driving work can be damped. The fastening between the centre piece 22 and the hammer body may also be implemented in an embodiment in such a way that there is impact and vibration damping material also between the fastening flange 25 and the bearing piece 63.

Figure 3:
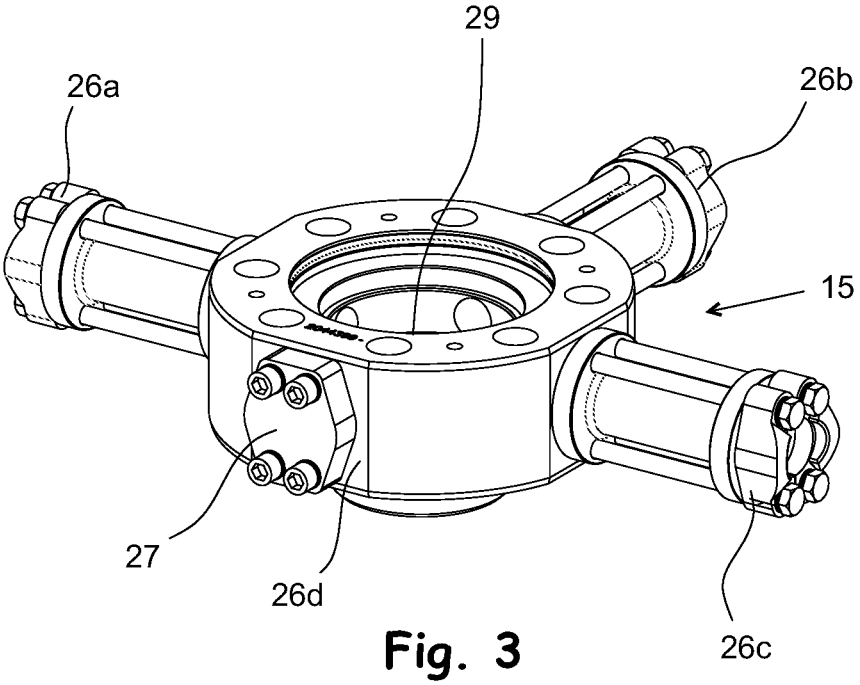
FIG. 3 shows a diagonal side view of the lower head of the driving cylinder of FIGS. 1 and 2 when detached from the driving cylinder.

In accordance with FIGS. 2 and 3, at the piston rod side head 15 are pressure medium connections 26*a*-26*d* for conveying pressure medium from outside the driving cylinder 10 to the piston rod side cylinder chamber 18 (that is, pressure medium inlet connections). Of these pressure medium inlet connections 26*a*-26*d* can be connected the desired number by means of pressure medium hoses or ducts into the hydraulic system of the pile driving rig. In the embodiment shown in FIGS. 2 and 3, there are three pressure medium inlet connections 26*a*-26*c* in use and one pressure medium inlet connection 26*d* is closed with an openable closing lid 27. In this embodiment, at the piston rod side head 15 there are no connecting ducts from the space between the outer cylinder liner and the inner cylinder liner to the piston rod side cylinder chamber, but the connection has been arranged only via the port connections 28 at the piston rod side end of the inner cylinder tube. The connection between the piston rod side cylinder chamber 18 and the space 16 between the outer cylinder liner 12 and the inner cylinder liner 13 is thus continuously open, that is, the pressure medium from the inlet connections is able to flow freely from the piston rod side cylinder chamber 18 to the space 16 between the outer cylinder liner 12 and inner cylinder liner 13. At the piston rod side head 15 is also a fitting opening 29 from which the piston rod 20 is fitted out of the cylinder part 11. The fitting opening 29 between the piston rod 20 and the piston rod side end 15 must be pressure-tight. For this purpose, the fitting opening 29 is dimensioned and sealed with gasket rings in such a way that the sealing between the piston rod 20 and the fitting opening 29 withstands the pressure of the pressure medium in the piston rod side cylinder chamber 18 without leaking.

Figure 4:
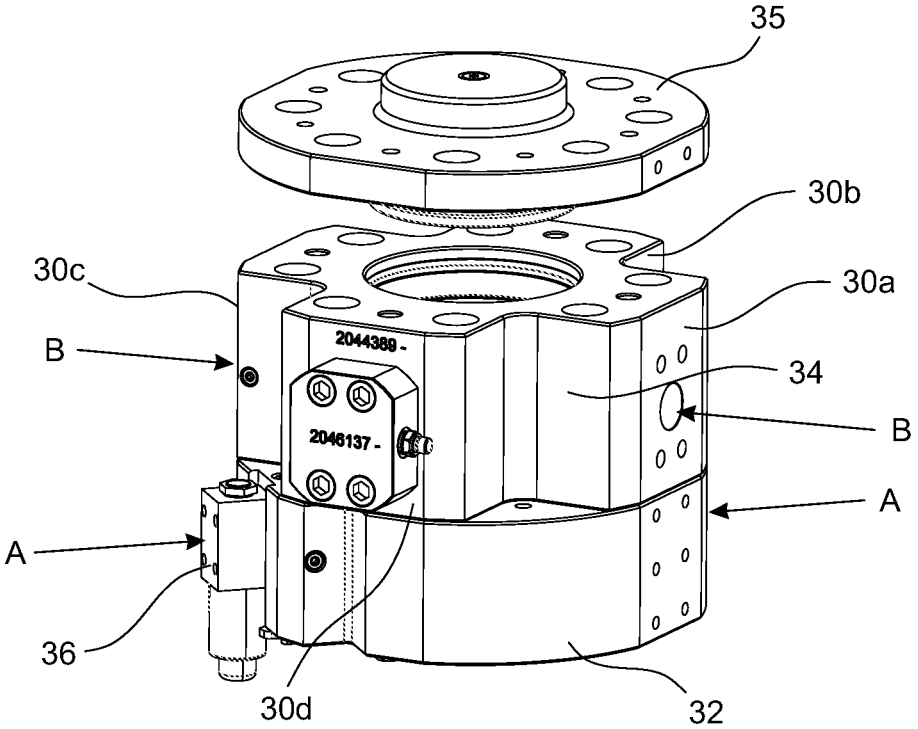
FIG. 4 shows a diagonal side view of the upper head of the driving cylinder of FIGS. 1 and 2 when detached from the driving cylinder.
Figure 5:
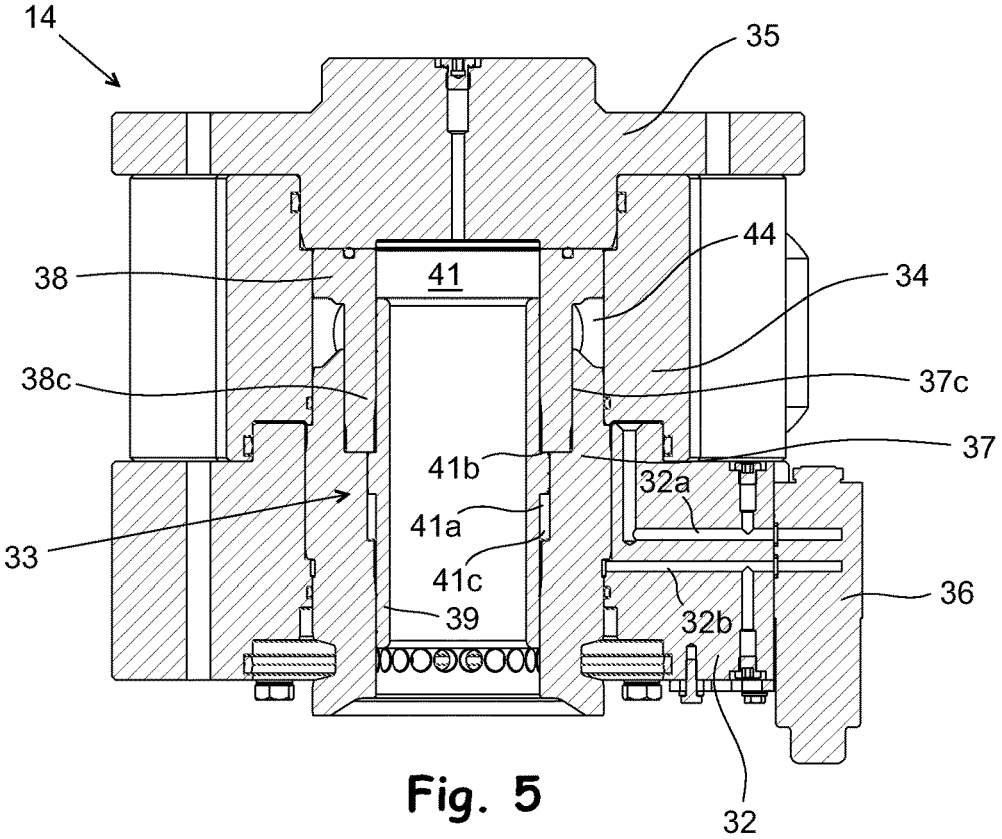
FIG. 5 shows a cross-section of the upper head of FIG. 4 as a section of the upper head at the electric pilot valve comprised therein (cross-section A-A shown in FIG. 4)

As can be seen in FIGS. 2, 4 and 6, in the driving cylinder 10 according to FIGS. 1 and 2, the outlet connections 30*a*-30*d* for conveying the pressure medium outside the driving cylinder 10 from the piston side cylinder chamber 17 are at the piston-side head 14. There are also four of these and 1-4 of them can be connected to the hydraulic system of the pile driving rig, where necessary. Furthermore, also at the piston-side end of the inner cylinder liner 13 are port connections 31 for connecting the interspace 16 between the outer cylinder liner 12 and the inner cylinder liner 13 to the piston-side cylinder chamber 17. At this head, the port connections 31 are, however, connected to the connection ducts 42 in the body 38 of the slide valve mounted inside the piston-side head 14. The connection ducts 42 can be closed and opened by means of the stem 39 moving inside the slide valve body 38.

The driving cylinder shown in FIGS. 1 to 10 is controlled by a slide valve 37 acting as a solenoid valve at the piston-side head 14. FIGS. 2, 4, 5 and 6 show the structure of the piston-side head 14 and of the slide valve 37. The piston-side head 14 comprises a head piece 32, a slide valve 33, a connecting block 34, a cylinder head 35 and a pilot valve 36 electrically controlling the operation of the slide valve 33.

The head piece 32 and the connecting block 34 form the body of the piston-side head 14, which body is fastened to the piston-side end of the outer cylinder liner 12 and inner cylinder liner 13. The slide valve 33 comprises a slide valve body 37, a slide valve head piece 38 and a stem 39. The head piece 32 in the piston-side head 14 has a valve chamber 40 inside which the slide valve body 37 is fitted. The slide valve body 37 has, at the cylinder head 35 side end, an inner extension 37*c*, to which may be fitted an adjusting part 38*c* of the slide valve head piece 38 corresponding to this extension. Inside the slide valve body 37 is a stem cylinder 41, inside which the stem 39 is configured to move over a distance determined by the extension 41*a* in the stem cylinder 41, reciprocating between the slide valve body 37 and the head piece 38 of the slide valve.

The stem 39 is a hollow, sleeve-like piece, which means that the pressure medium coming from inside the inner cylinder liner 13 may flow to the outlet ducts 44 through the stem 39. Due to this, the stem 39 is always in balance with respect to the forces exerted on it by the pressure medium. Therefore, reciprocating the stem 39 inside the slide valve 33 does not require strong forces in any situation. The hollow stem 39 is also light and can, therefore, be moved more easily (with less force) sufficiently fast.

Moving the stem 39 takes place by means of a pressure medium conveyed to control chambers formed between the lug 39*a* on the outer surface of the stem 39 and the inner extension 41*a* (alternately on both sides) in the middle of the stem cylinder 41. At the piston-side cylinder chamber 17 end of the slide valve body 37 are connecting holes 42 which connect the piston-side cylinder chamber 17 of the stem cylinder 41 via the connecting openings 31 at the piston-side end of the inner cylinder liner 13 with the space 16 between the outer cylinder liner 12 and the inner cylinder liner 13. In the head piece 38 of the slide valve 33 are outlet holes 43 corresponding to the connecting holes in the slide valve body 37, through which holes the pressure medium is able to flow from the piston-side cylinder chamber 14, through the pressure medium outlet ducts 44 in the connecting block 34, outside the driving cylinder 10. As can be seen from FIGS. 2, 5 and 6, when the stem 39 is in the first position, that is, moved to its extreme position on the slide valve head piece 38 side, the said outlet holes 43 are blocked and the connecting holes 42 open, whereupon the pressure medium is able to flow freely from the piston-side cylinder chamber 17 into the space 16 between the outer cylinder lining 12 and inner cylinder lining 13, but not into the pressure medium outlet ducts 44. When the stem 39 is in the second position (that is, moved to its extreme position on the side of the piston-side cylinder chamber 17), the connecting holes 31 of the inner cylinder liner 13 are blocked, whereupon the pressure medium is not able to flow from the piston-side cylinder chamber 17 into the space 16 between the outer cylinder lining 12 and inner cylinder lining 13 (or vice versa). In this way, the pressure in the piston-side cylinder chamber 17 may be varied by reciprocating the stem 39 of the slide valve 33. This causes the piston part 19 (i.e. the piston 21 and the piston rod 20)) of the driving cylinder to reciprocate inside the inner cylinder part 13 and to thus move the ram block at the end of the piston rod back and forth inside the hammer. Furthermore, since in the driving cylinder 10 all of the pressure medium flows into the outlet ducts 44 through the stem 39 which is hollow inside, the driving cylinder may alternatively also be implemented so as to have "a top rod", that is, so that the piston rod extends outside the cylinder part also through the piston-side head.

Described more specifically, the operation of the slide valve 33 and its effect on the piston part 19 of the driving cylinder 10 is as follows: When the slide valve 33 stem 39 is moved to the first position, that is, to its extreme position on the slide valve head piece 38 side, the pressure in the piston-side cylinder chamber 17 of the driving cylinder rises to the same level as in the piston-rod side cylinder chamber 18. This causes the piston part 19 to move in the direction of the piston rod side head 15 (that is, downwards when the driving cylinder is inside the hammer during the driving of the pile into the ground), because the surface area of the piston 21 under pressure in the piston-side cylinder chamber 17 is greater than in the piston rod side cylinder chamber 18. When the stem 39 is moved into the second position, that is, to its extreme position on the side of the piston-side cylinder chamber 15, the pressure in the piston-side cylinder chamber 14 falls, whereupon the piston part 19 moves in the direction of the piston-side head 14 (that is, upwards when the driving cylinder is inside the hammer during the driving of the pile into the ground), because now the pressure in the piston-rod side cylinder chamber 18 remains the same, but the pressure in the piston-side cylinder chamber 17 falls to zero since the pressure medium outlet holes 43 connected to the outlet ducts 44 are open and the connection from the piston-side cylinder chamber 17 to the space 16 between the outer cylinder part 12 and the inner cylinder part 13 is closed. As may be noted from the above performance specification, controlling the driving cylinder 10 only requires one slide valve 33 (e.g. of the type described above), which is located in the piston-side head 14 of the driving cylinder 10.

Controlling the movements of the slide valve 33 stem 39 in a driving cylinder according to FIGS. 1 and 2 takes place by means of an electric pilot valve 36 which is fastened to the head piece 32 of the piston-side head 14. From the head piece 32 leads an inlet connecting channel 32*a* and an outlet connecting channel 32*b* to connecting holes 37*a* and 38*a* formed for these connecting channels at the corresponding points of the slide valve body 37 and the slide valve head piece 38, through which holes the pressure medium conveyed to the pilot valve connections formed in the head piece 32 (including the inlet and outlet connections on both sides of the lug 39*a* of the stem 39) can pass to the connecting holes 37*a* and 38*a*, and via them further to the control chambers 41*b* and 41*c* of the slide valve 33. The pilot valve 36 then controls on which side of the lug 39*a* of the stem 39 (that is, into which controls chamber 41*b* or 41*c*) the pressure medium driving the slide valve 33 is conveyed and from which control chamber 41*b* or 41*c* the pressure medium between the stem 39 and the inner extension 41*a* of the stem cylinder 41 in the slide valve body 37 is discharged. In this way, by means of the pilot valve 36 the stem 39 can be controlled to move in either of the above-mentioned extreme positions.

In the pilot valve 36 according to this embodiment is an electric solenoid (that is, a magnetic valve) which, when moving into the first extreme position, blocks the connection to the outlet connecting channel 32*b* led to the piston-side control chamber 41*b* of the slide valve 33 and opens the inlet connecting channel 32*a* led to it, and opens the outlet connecting channel 32*b* led to the cylinder head side control chamber 41*c* and closes the inlet connecting channel 32*a* led to it. When moving into the second extreme position, the magnetic valve in turn blocks the connection to the inlet connecting channel 32*a* led to the piston-side control chamber 41*b* of the slide valve 33 and opens the outlet connecting channel 32*b* led to it, and opens the inlet connecting channel 32*a* led to the cylinder head side control chamber 41*c* and closes the outlet connecting channel 32*a* led to it. In this way, by means of the pilot valve 36, the stem 39 of the slide valve 33 can be guided into the desired position (that is, to the above-mentioned first or second position) by means of electric control commands (in this case 24 V direct voltage), that is, the movement of the piston part 19 of the driving cylinder 10 according to FIGS. 1 and 2 can thus be controlled by means of electric control commands given to the pilot valve 36. These electric control commands can be generated in the control unit of the pile driving rig, for example, in accordance with a program determined by the user, or manually by means of the controls in the cabin of the pile driving rig.

The driving cylinder according to the invention can be implemented, in many respects, in a manner deviating from the example embodiment presented above. The slide valve located in the piston-side end and acting as a solenoid valve could be implemented at least partly in a different manner. In another embodiment, the slide valve could be implemented, for example, in such a way that it is composed of the same part as the body part of the head, and even in such a way that the piston-side head comprises only two parts (body part and head part) and the stem located inside the stem cylinder. On the other hand, in another case the piston-side head may comprise even more separate parts than the piston-side driving cylinder according to FIGS. 1 and 2. In another embodiment, the outer cylinder liner and the inner cylinder liner do not include connection openings, but the connection from the space between the inner cylinder liner and the outer cylinder liner to the piston-side cylinder chamber and the piston rod side cylinder chamber is implemented by means of connecting channels made in the piston-side head and the piston-rod side head. In this type of an embodiment, the stem of the slide valve acting as a control valve may be located completely inside the piston-side head. The positioning of the studs used for fastening the heads of the driving cylinder could in another embodiment also be implemented in such a way that the piston-side studs are positioned at different points in the circumferential direction of the cylinder liners with respect to one another, for example, in such a way that, with respect to the piston rod side studs, the piston-side studs are positioned approximately in the middle of the distance between them. In another embodiment, the fastening of the heads and the centre piece could also be implemented in such a way that the position of the centre piece is adjustable by means of the studs. In this case, the lug in the outer cylinder liner is left out, whereupon the position of the centre piece may be adjusted by screwing the studs suitably over a small distance. Should it be desirable to change the position of the centre piece more, this can be done by replacing the studs with other studs of different length. Furthermore, many other structural details of the driving cylinder can be implemented in a manner deviating from example embodiment. For example, the number and location of the pressure medium outlet connections formed in the piston-side head and the outlet ducts formed inside the head piece, the pressure medium inlet connections and inlet ducts formed in the piston-rod side head may vary in different embodiments of the driving cylinder. Also the impact and vibration damping fastening of the driving cylinder to the hammer could be implemented by using a different suitable material for damping impacts and vibration than polyurethane in the fastening structures between the centre piece and the hammer body. Such material could be, for example, a suitable rubber or plastic or other flexible but sufficiently strong and durable material. Consequently, the driving cylinder according to the invention is not limited to the example embodiment disclosed above, but may vary within the scope of the appended claims.

The invention claimed is:

1. A driving cylinder of a pile driving rig comprising:

a cylinder part with an outer cylinder liner and an inner cylinder liner fitted within each other, a piston part comprising a piston rod extending from inside the inner cylinder liner outside it, wherein in the part inside the inner cylinder liner is a piston fitted tightly and reciprocatingly inside the inner cylinder liner, and in the part, extending outside the inner cylinder liner is a fixture for fastening the piston rod to a ram block, a piston-side head which is fastened tightly to a piston-side end of the outer cylinder liner and the inner cylinder liner, in such a way, that a pressure medium conveyed inside the driving cylinder will not be able to leak outside the driving cylinder through a joint between the piston-side head and the outer cylinder liner and inner cylinder liner, a piston rod side head which is fastened tightly to a piston rod side end of the outer cylinder liner and the inner cylinder liner, in such a way, that a pressure medium conveyed inside the driving cylinder will not be able to leak outside the driving cylinder through a joint between the piston rod side head and the outer cylinder liner and inner cylinder liner, at least one pressure medium outlet connection at the piston-side head for conveying a pressure medium outside the driving cylinder, and pressure medium ducts for connecting the at least one pressure medium outlet connection and an interspace between the outer cylinder liner and the inner cylinder liner to a piston-side cylinder chamber limited by the piston-side head, the inner cylinder liner, and the piston, at least one pressure medium inlet connection at the piston rod side head for conveying a pressure medium from outside the driving cylinder into the driving cylinder, and pressure medium ducts for connecting the interspace between the outer cylinder liner and the inner cylinder liner to a piston rod side cylinder chamber limited by the piston rod side head, the inner cylinder liner and the piston, fastening means for fastening the driving cylinder to a hammer of the pile driving rig, and a solenoid valve for controlling the pressure medium ducts of the driving cylinder, which solenoid valve, is a slide valve, which is located at least partly at the piston-side head of the driving cylinder, and a stem of which slide valve, is at least partly outside the inner cylinder liner in a direction of motion of the piston part.

2. The driving cylinder of the pile driving rig according to claim 1, wherein the stem of the slide valve is arranged to move from inside the piston-side head at least partly inside the inner cylinder liner.

3. The driving cylinder of the pile driving rig according to claim 1, wherein the stem of the slide valve is arranged to move from a first position to a second position and from a second position to a first position, and in which first position, the stem closes pressure medium outlet ducts at the piston-side head which are led outside the driving cylinder from the piston-side cylinder chamber, and in which second position, the stem closes a connection between the interspace between the outer cylinder liner and the inner cylinder liner and the piston-side cylinder chamber.

4. The driving cylinder of the pile driving rig according to claim 1, wherein the piston-side head comprises a head piece, a connecting block and a cylinder head which are separate from one another and fastened to each other by means of detachably openable fastening means.

5. The driving cylinder of the pile driving rig according to claim 4, wherein the head piece of the piston-side head is fastened against the outer cylinder liner and inner cylinder liner, and the connecting block is between the cylinder head and the head piece.

6. The driving cylinder of the pile driving rig according to claim 4, wherein the piston-side head and the piston rod side head are fastened to the outer cylinder liner and the inner cylinder liner with studs pulling the head pieces against the outer cylinder liner and the inner cylinder liner.

7. The driving cylinder of the pile driving rig according to claim 1, wherein the slide valve comprises a slide valve body and a slide valve head piece separate from one another, which are fitted inside a valve space formed inside the piston-side head.

8. The driving cylinder of the pile driving rig according to claim 7, wherein inside the slide valve body and the slide valve head piece is a stem cylinder, wherein the stem is configured to reciprocate from a first position to a second position and from a second position to a first position.

9. The driving cylinder of the pile driving rig according to claim 1, further comprising a centre piece fastened between the piston-side head and the piston rod side head.

10. The driving cylinder of the pile driving rig according to claim 9, wherein the centre piece comprises a fastening flange located at the centre of gravity of the driving cylinder.

11. The driving cylinder of the pile driving rig according to claim 10, further comprising piston-side studs and piston rod side studs, and in which driving cylinder, the piston-side studs are fastened between the piston-side head and the centre piece and the piston rod side studs are fastened between the centre piece and the piston rod side head.

12. A pile driving rig comprising a driving cylinder according to claim 1.

13. The pile driving rig according to claim 12, wherein the driving cylinder is fastened to the hammer of the pile driving rig from the centre piece of the driving cylinder by means of a bearing piece damping impacts and vibrations.

14. The pile driving rig according to claim 13, wherein the centre piece comprises a fastening flange, to which, the bearing piece detachably fastened to the hammer body is fastened.

15. The pile driving rig according to claim 13, wherein the bearing piece comprises an inner part and an outer part and between them, at least one damping material piece damping impacts and vibration.

16. The pile driving rig according to claim 15, wherein the impact and vibration damping material is polyurethane.

17. The pile driving rig according to claim 12, wherein the piston rod of the driving cylinder is fastened to the ram block reciprocated inside the hammer of the pile driving rig by means of a fixture at the end of the piston rod damping impacts and vibrations.

18. The pile driving rig according to claim 17, wherein the fixture comprises a lifting disc, which is fastened to the ram block by means of at least one damping material piece of impact and vibration damping material.

19. The pile driving rig according to claim 18, wherein the ram block comprises a head piece and a body and wherein there is at least one damping material piece between the lifting disc and the head piece of the ram block and at least one damping material piece between the lifting disc and the body of the ram block.

20. The pile driving rig according to claim 17, wherein the fixture comprises a fastening sleeve and a lifting disc, and in which fixture the lifting disc is fastened to the fastening sleeve with openable fastening means and the piston rod is fastened to the fastening sleeve by means of a wedge attachment.

21. The pile driving rig according to claim 20, wherein the attachment is formed by means of a conical sleeve fitted between the fastening sleeve, the lifting disc and the piston rod.

* * * * *